US005279243A

United States Patent [19]

Cole

[11] Patent Number: 5,279,243

[45] Date of Patent: Jan. 18, 1994

[54] ROTATABLE BOLLARD FOR USE WITH WIRE ROPES

[76] Inventor: David Cole, 31 Rue Charles DeGroux, Etterbeek, Brussels 1040, Belgium

[21] Appl. No.: 960,823

[22] Filed: Oct. 14, 1992

[30] Foreign Application Priority Data

Jul. 10, 1992 [GB] United Kingdom ..... 9214646

[51] Int. Cl.[5] ..... B63B 21/04

[52] U.S. Cl. ..... 114/218

[58] Field of Search ..... 114/218, 230, 249, 181; 294/82.34

[56] References Cited

U.S. PATENT DOCUMENTS 3,073,276 1/1963 Taylor ..... 114/218

FOREIGN PATENT DOCUMENTS 247060 6/1969 U.S.S.R. ..... 114/218
871526 6/1961 United Kingdom .
1219568 1/1971 United Kingdom .
2093784 9/1982 United Kingdom .

*Primary Examiner*—Jesus D. Sotelo
*Attorney, Agent, or Firm*—James Creighton Wray

[57] ABSTRACT

For securing a heavy wire rope (hawser), usually to the bow or stern of a large vessel but alternatively to an oil rig or jetty, a bollard comprises (a) a base securable to a deck and having an upstanding cylinder around which is an angled skirt or a plurality of angled brackets;

(b) an upper portion having a cylinder which fits rotatably within the base, and on top of which is a round plate on which is fixed a fin, usually a pear-shaped base and the upper portion of which extends at an acute angle to the horizontal and terminates in a narrow peak under which is a notch for retaining the rope, and (c) for retaining the two portions in a desired non-rotating position, corresponding lateral holes in the respective cylinders and at least one locking bar which can be inserted through both cylinders.

The upper portion can be rotated manually by inserting a bar in a hole beneath the peak of the fin; or by means of a small motor.

The two sections may have respective screw threads.

The bollard allows a heavy rope to be secured or released by one man.

9 Claims, 2 Drawing Sheets

ROTATABLE BOLLARD FOR USE WITH WIRE ROPES

BACKGROUND OF THE INVENTION

This invention relates to a rotatable bollard used for securing and releasing heavy wire ropes.

Known bollards normally are of fixed construction, and are of generally cylindrical shape. For use on a ship it is usual to have a pair of cylinders quite close together.

The bollard of the invention is designed to be installed at the bow and stern of large vessels so as to secure and release the eye of a heavy wire-rope from a tug or another vessel; and to be installed on board floating terminals, oil rigs, barges and fixed oil field structures where heavy wire ropes are used and normally handled by gangs of men by appropriate equipment. It is also usuable on a jetty, set in concrete.

My invention provides the advantages that:

a) securing and releasing of a rope or hawser can be a one-man operation;

b) power is no longer needed for releasing the rope;

c) the heavy wire-ropes involved are untouched by man; and d) it avoids the use of "chain stoppers", with their inherent dangers.

SUMMARY OF THE INVENTION

According to the present invention I provide a rotatable bollard for use in securing a rope or hawser, which comprises:

(a) a base portion comprising a flange which is securable to the deck of a vessel, oil rig, jetty or other structure and, upstanding from said flange a housing having a cylindrical interior and a tapered external skirt or tapered members fitted at an angle to the exterior of the housing and over which a rope or hawser can slide;

(b) an upper portion having at its foot a cylinder which fits into the cylindrical interior of the base portion (a) so as to be manually rotatable therein, the upper end of this portion being a fin extended at an acute angle to the horizontal and terminating substantially in a narrow peak with a sharp upper edge, below which peak is formed a V-shaped notch whereunder the rope or hawser can be retained, the remaining upper surface of the fin being curved to allow the rope or hawser to slide thereover when it is being released, and (c) means for securing the portions (a) and (b) in a desired non-rotating position.

DETAILED DESCRIPTION OF THE DRAWINGS

The rotatable bollard of the invention comprises two steel portions, the upper finned (A) which usually has a pear-shaped base, and the base (B), both of which include a cylinder as an integral part so that the finned cylinder can slide into and/or screw into the base cylinder leaving the fin section (A) rotatable. In the illustrated embodiments of FIGS. 1–4, both cylinders have threaded bottom ends to fit each other (16,18).

Figure 4:
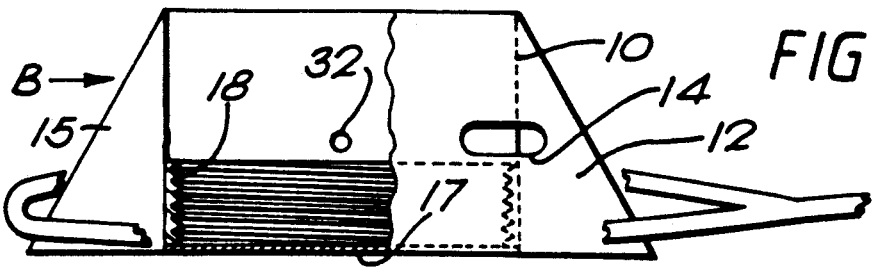
FIG. 4 is a side view of the base section showing a slackened hawser position.
Figure 5:
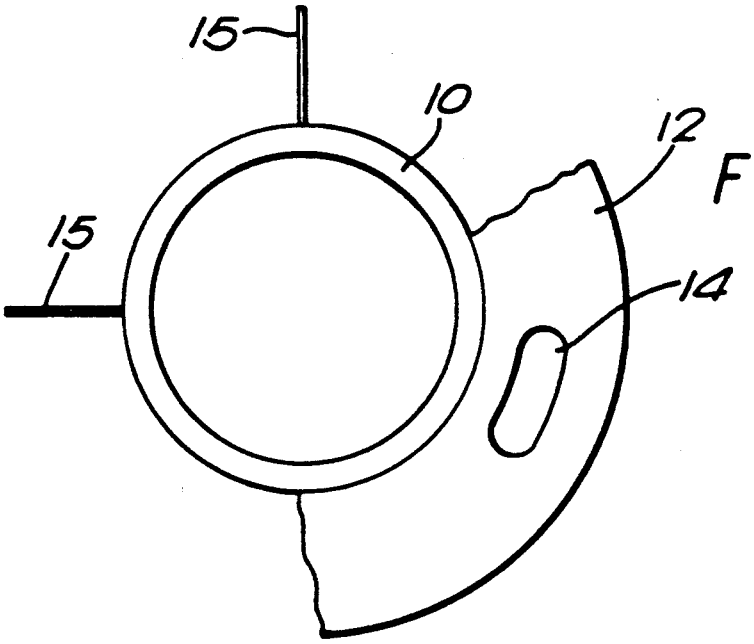
FIG. 5 is a plan view of the base section showing alternative forms of its tapered surround.

As seen in FIGS. 4 and 5, the base portion (B) is a cylinder 10 encased in a tapered surrounding member fitted to the deck, which can be an angled steel skirt 12, which has access apertures 14 (FIG. 5) or a plurality of angled brackets 15; the tapered member must not obstruct the path of the eye of a heavy wire-rope. This base section is intended to be welded or otherwise secured to the deck of a ship or marine structure or secured to a concrete foundation in a jetty; the tapered surround 12 or 15 should likewise be secured to the deck etc.

A hole 26 at the front of the fin or a pair of lateral holes 27 is provided into which a bar can be inserted to turn the upper portion. Corresponding holes 30, 32 are provided in the two cylinders to allow insertion of locking bars, accessed through the apertures 14 in a surrounding skirt.

Alternatively for rotation of the upper portion a small electric motor (an air-driven motor in the case of tankers or oil fields) can be fitted inside the base; the upper portion should then still be arranged to be manually rotatable.

Figure 1:
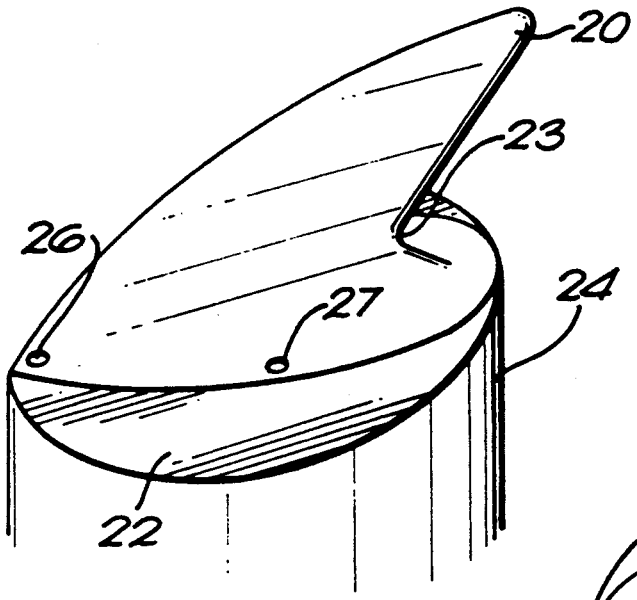
FIG. 1 shows in perspective an embodiment of the upper portion and the adjacent part of the lower portion of a bollard according to the invention.
Figure 2:
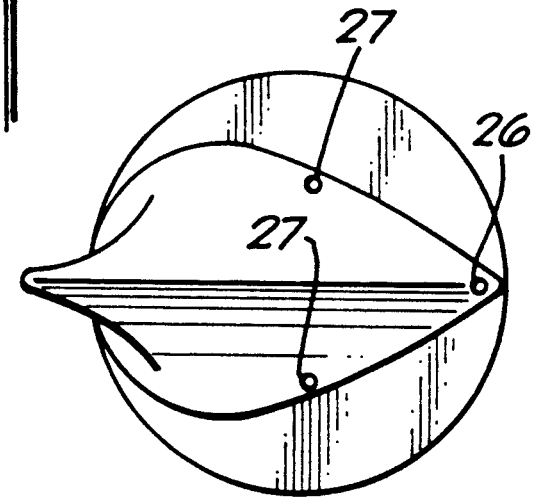
FIG. 2 is a plan view of the upper portion.
Figure 3:
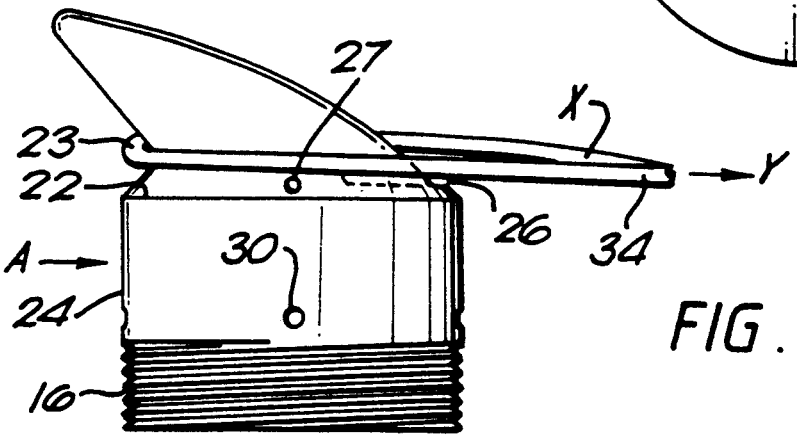
FIG. 3 is a side view of the upper portion showing the position of a hawser secured thereto.

The upper section (A) has a fin 20, shaped preferably as shown in FIGS. 1–3, which is welded to a round steel plate 22 which forms the top of a cylinder 24 of a diameter to fit within the base. The "V" shaped notch 23 below the tip of the fin and serving to hold the hawser must be wide and round to protect a wire rope, i.e. not to bend it, and must be sufficiently above the plate 22 to allow clear access of a turning bar to the holes 26 or 27 while the hawser is in its secured position in the notch 23. The curved upper edge of the fin changes its angle with the change in hawser angle.

Figure 6:
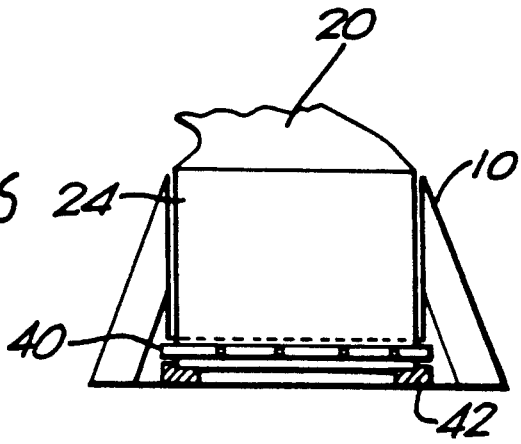
FIG. 6 is a section of the base of an alternative embodiment wherein the portions are not screwed together.

In another embodiment where the two cylindrical portions fit together without thread, the upper cylinder 24 is longer than the lower cylinder 10 and protrude below the bottom of the lower cylinder as shown in FIG. 6. The lower cylinder is supported above the deck by tapered members 12 or 15. It is seated in a flange 42 fixed to the deck, an collar 40 is bolted on so as to secure it from rising up. This may be a preferred arrangement, especially if screw threads cannot take the pressure of say a 100-tonne pull (although threads should not be affected if the cylinders are a close fit and in any case the tension is not actually on the threads).

The two sections can be partly or fully separated by unscrewing and/or sliding out for inspections and greasing.

The tapered portion (skirt 12 or angled brackets 15) will cause the hawser to rise to position X as shown in FIG. 3 when the visiting ship pulls in direction Y. If there was no taper, the hawser would stay at deck level as in FIG. 4 and be caught there and could never be automatically released.

On releasing, when the visiting ship slackens the hawser, it will still stay in position due to the huge weight of the rest of the hawser being e.g. some 30 meters long and hanging over the sea, which is much too heavy to handle manually.

The conventional method of releasing is to secure a second rope to the hawser at the end of its eye, at 34 and heave it by winch towards the bollard, thus releasing tension at the bollard, then several seamen lift it over the fixed vertical bollard. It is also done by crane and winch in the oil field.

The bollard is used as follows:

Securing: The usual small tail-rope (not shown) method is used to heave a heavy wire-rope adjacent to the bollard where the tail-rope passes slightly below the top of the fin 20. When the wire-rope eye arrives, touching the fin tip, heaving stops and the eye is allowed to drop over the fin, unassisted and is caught at position X.

Releasing: Once the wire-rope is slack, one man inserts a steel bar into the small hole 26 or holes 27 provided in the lower end of the upper finned portion (A), and turns or levers through 180°, allowing the heavy eye of the rope to slip free, unassisted. Alternatively, if a motor is provided, thus would be used for rotation. The small tail-rope is used in the normal way, for safe practice. The fin cannot safely be touched by hand when it is turning.

Locking the fin portion in the required direction: The same lever bar can be inserted in one of the several lateral holes 32 which pass through both cylinders and are located on each side of the base section, so as to stop the upper portion (A) from rotating. Access is gained to the side holes 32 through the larger apertures 14 in a skirt 12. The same side holes can be used to store the lever bar in.

Figure 7:
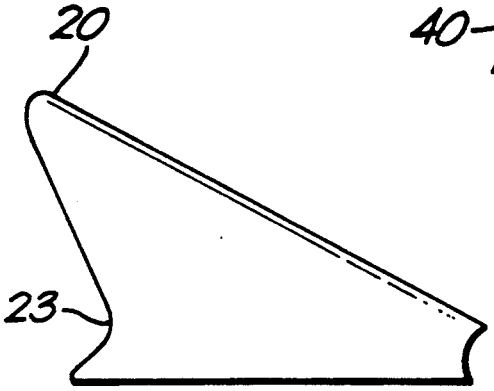
FIGS. 7 and 8 show in side view alternative shapes of the fin on the upper portion.
Figure 8:
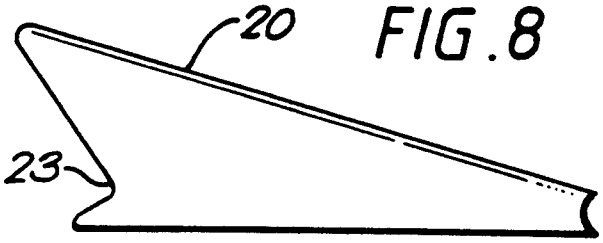

The upper portion can have shapes differing somewhat from that shown in FIGS. 1 to 3 provided that the rope or hawser can readily be secured and released therefrom. FIG. 7 shows a steeper angled fin, but this may be difficult for the rope to slip off. FIG. 8 shows along low fin, but this needs a larger diameter cylindrical portion.

The base of the upper portion is conveniently made pear-shaped as shown, but could also be round or oval.

Dimensions: A bollard of the invention acceptable to classification societies will have cylinders with at least the same dimensions as required for conventional cylinder-shaped bollards presently in use and will meet the safe standards for "bollard pull" requirements. As an example, in the case of large ships, such a bollard could be 1 meter high to the fin peak and 70 centimeters diameter of the cylinders.

I claim:

1. A rotatable bollard for use in securing a rope or hawser, which comprises:

(a) a base portion comprising a flange which is securable to the deck of a vessel, oil rig, jetty or other structure and, upstanding from said flange, a housing having a cylindrical interior and a tapered external member fitted at an angle to the exterior of the base portion so that a rope or hawser can slide thereover.

(b) an upper portion having at its foot a cylinder which fits into the cylindrical interior of the base portion so as to be manually rotatable therein, the upper end of this portion being a fin extended at an acute angle to the horizontal and terminating substantially in a narrow peak with a sharp upper edge below which peak is formed a notch whereunder the rope or hawser can be retained, the remaining upper surface of the fin being curved to allow the rope or hawser to slide thereover when it is being released, and (c) means for securing the base and upper portions in a desired non-rotating position.

2. A bollard as claimed in claim 1, wherein the base and upper portions are threaded so that the upper portion screws into the base portion.

3. A bollard as claimed in claim 1, wherein the tapered external member is a circular part-conical angled skirt.

4. A bollard as claimed in claim 1, wherein the tapered external member is composed of a plurality of angled brackets.

5. A bollard as claimed in claim 1, wherein several holes are formed in both cylindrical portions to allow the passage of at least one locking element through the respective holes.

6. A bollard as claimed in claim 1, where the upper edge of the upper portion forms an elongated curve.

7. A bollard as claimed in claim 1, wherein the base of said fin is pear-shaped in plan.

8. A bollard as claimed in claim 1, wherein the notch formed under the peak of the fin for retention of the rope or hawser is of rounded V-shape.

9. A bollard as claimed in claim 1, wherein at least one hole is located on the fin at a position away from the fin peak, to allow a lever bar to be fitted in said hole for manual rotation of the upper portion.

* * * * *